US006216763B1

(12) United States Patent
Ruehl et al.

(10) Patent No.: US 6,216,763 B1
(45) Date of Patent: Apr. 17, 2001

(54) CAST NODE AND METHOD FOR CASTING NODES

(75) Inventors: Phillip C. Ruehl, Elm Grove; Stephen L. Kretschmer, Mequon, both of WI (US)

(73) Assignee: R. J. Tower Corporation, Grand Rapids, MI (US)

( * ) Notice: Subject to any disclaimer, the term of this patent is extended or adjusted under 35 U.S.C. 154(b) by 0 days.

(21) Appl. No.: 09/166,638

(22) Filed: Oct. 5, 1998

(51) Int. Cl.[7] ..... B22D 19/00
(52) U.S. Cl. ..... 164/98; 164/111; 164/112
(58) Field of Search ..... 164/98, 111, 112

(56) References Cited

U.S. PATENT DOCUMENTS 3,844,024 * 10/1974 Otto ..... 164/111
5,226,469 * 7/1993 Matsumura et al. ..... 164/111

FOREIGN PATENT DOCUMENTS 55-2148 * 1/1980 (JP) .

* cited by examiner

*Primary Examiner*—Harold Pyon
*Assistant Examiner*—I.-H. Lin
(74) *Attorney, Agent, or Firm*—Oppenheimer Wolff & Donnelly LLP; Craig J. Lervick

(57) ABSTRACT

A method of connecting elements in a vehicle frame includes fixing the elements in a desired orientation, positioning dies to surround a portion of each element, and introducing material into the die cavity thereby casting a node around the elements.

18 Claims, 7 Drawing Sheets

130
102
101
125

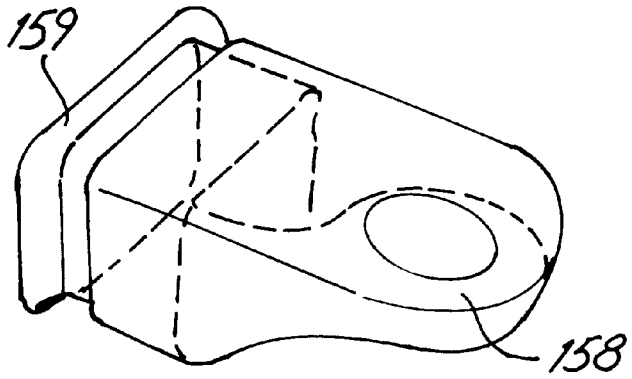
Fig. 6
Fig. 7
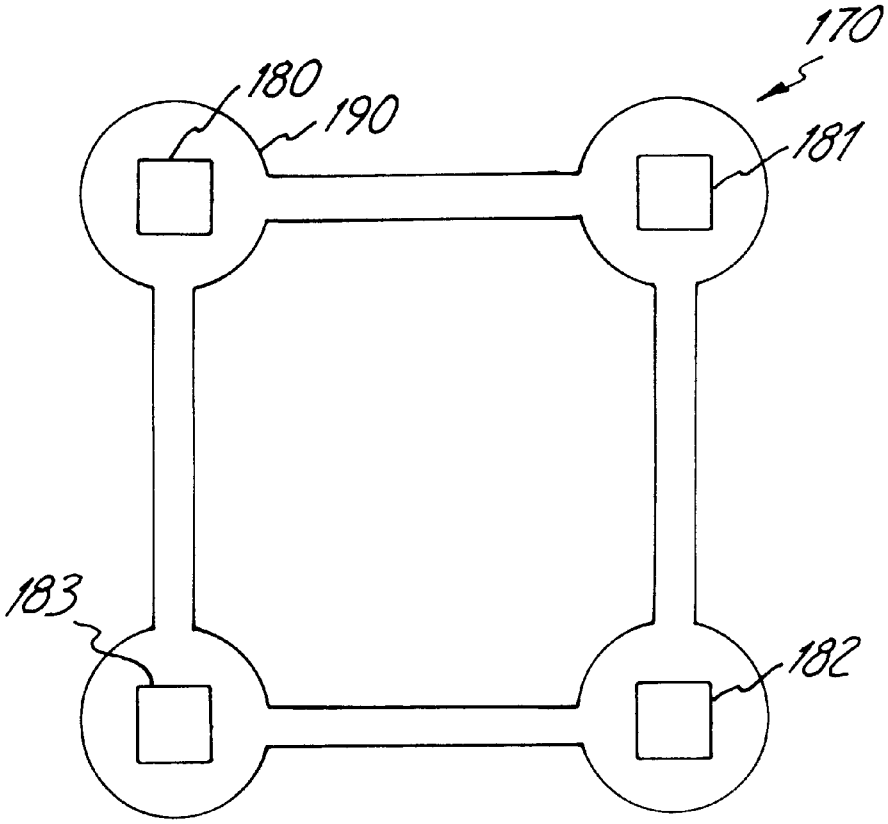

CAST NODE AND METHOD FOR CASTING NODES

BACKGROUND OF THE INVENTION

The present invention relates to a method of joining elements in vehicle structures. More specifically, the present invention relates to a method of joining elements by casting around them as they are held in a desired configuration and to a node formed by such a method.

In many instances, it is necessary to create structural members such as frames to provide overall support to component devices. This is particularly true in the manufacture and assembly of vehicles such as automobiles, trucks, sport utility vehicles and the like. Such a vehicle frame is shown in U.S. Pat. No. 5,149,132 entitled SPLIT REAR TRUCK FRAME, which is assigned to the assignee of the present invention and is incorporated herein by reference. Another example of such a truck frame and its related mounting structures can be found in U.S. Pat. No. 5,308,115 entitled VEHICLE FRAME WITH OVERLAPPED SECTIONS, also assigned to the assignee of the present invention and incorporated herein by reference.

A vehicle is assembled, at least in part, by constructing a frame or main assembly and attaching subassemblies and components to the frame. The frame includes two generally parallel, spaced-apart side rail members which run substantially the length of the vehicle. Cross members span the distance between the side rails and are attached at their ends to the side rail members. Vehicle subassemblies and components include the engine cradle, suspension system, body panels, control arms, rear box load, cab, brake and fluid lines, and the like.

The unions or connections between elements are made directly or indirectly. Typically, direct unions are made by welding, bolting, riveting or the like. Indirect unions involve attaching a bracket to one member and then attaching a component to the bracket. Brackets are typically configured to accommodate a single particular component, and are typically attached by bolting, riveting, welding or the like.

Using bolting, riveting, and welding for these joints has a number of disadvantages. For example, one disadvantage with bolting, riveting, or welding involves the "fitting up" of the elements to be joined. That is, for a bolt or rivet to properly join two elements, the two elements must perfectly abut each other, or be fairly precisely parallel to one another. If one element is disposed at an angle to the element to which it is to be joined, the bolt or rivet will not be able to pull the two elements securely together. Therefore, careful orientation of the two elements is required to prepare the two elements for bolting, riveting, or welding.

Another disadvantage with bolting and riveting is that holes must be machined or stamped into the elements to accommodate bolts or rivets. This involves an additional manufacturing step, which increases the time, labor, and cost of the vehicle frame.

Bolting and riveting is further disadvantageous because the holes in the two elements to be joined must precisely match up. Therefore, tolerances for the placement of the holes must be fairly rigorously maintained. This increases the labor and therefore the cost of manufacturing the vehicle frame.

A still further disadvantage of bolting, riveting, and welding, involves the "stack up" of tolerances when multiple elements are joined. The elements must be designed to accommodate each other when mating features of each element, such as size and placement of holes for bolting, are at the extreme edges of their respective tolerance ranges. This is of particular concern when, for example, two elements are joined to one another and then joined to a third element. The third element must accommodate the stacked up tolerances or the sum of the tolerances of the first two elements.

A disadvantage to connecting elements through bracketry is that the brackets or mounting members are extra elements, requiring time and labor to produce and assemble. Further, additional parts require additional time and labor in regulating quality control and in tracking and storing inventory. This increases the cost of the resulting vehicle frame.

In light of the above-described disadvantages, it would be desirable to provide a method of joining or connecting elements that does not rely upon bolting, riveting, or welding. Further, it would be desirable to provide a joining method that eliminates the need for mating surfaces to match or "fit up" and to be precisely positioned for connection. Still further, it would be desirable to provide a connecting method that does not require specific structure, such as holes for bolting or riveting, to be incorporated into the elements to be joined. Further, it would be desirable to provide a method of uniting elements that would eliminate the stack-up of tolerances when multiple elements are joined.

SUMMARY OF THE INVENTION

In light of the above described problems with prior art devices and in keeping with the objectives discussed above, the present invention provides a method of joining or uniting elements in a vehicle structure. In this method, joints or nodes are cast around the elements to be joined. More specifically, the present invention provides a method of joining or uniting elements by positioning the elements and fixing them or holding them in place, and then casting a joint or node around them. Still more specifically, the present invention involves a method of joining elements in a vehicle frame including the steps of fixing elements in a desired orientation; providing complimentary dies which define an interior cavity; positioning the dies about the mating portion of the elements, such that the mating portions extend into the die cavity; introducing material under pressure into the die cavity and filling the die cavity; and removing the dies, leaving a molded joint connecting the elements in a desired orientation, with the molded joint having the shape of the die cavity.

This method may be used to connect a variety of elements that ultimately form a vehicle structure. For example, this method can be used to connect a main member to another main member or to a bracket. Examples of main members include side rail members and cross members which form the vehicle frame. In addition, elements which form subassemblies for the engine cradle and for the rear suspension can be assembled according to this method and can then be connected to the frame using this method. Further, this method can be used to mold brackets or other mounting members into a joint between elements. Still further, this method can be used to attach a contact plate to a member, such that that member can then be bolted or riveted to another member that is made of a material incompatible with the first member. This method can also be used to connect brackets or other mounting surfaces to one another in a matrix formation.

This process of casting a node or joint around elements avoids the need for machining or stamping holes in the elements to accommodate bolts or rivets. Further, mating members are not required to have similarly contoured and nearly perfectly oriented mating surfaces as would be required for bolts, rivets and welds to make a secure connection. The present invention further provides a method of joining elements without the stacking up of tolerances of the elements to be joined. Still further, this method allows the use of steel for large members that must be of high strength, while also allowing the use of lighter materials, such as aluminum, for the relatively small and complexly shaped molded nodes. In this manner, large members can be of relatively cheap material while more expensive materials can be reserved for the comparatively small nodes. Nodes made by the method of the present invention can be molded to spread the stresses of the joint to a greater degree than is allowed by welded, bolted or riveted joints.

It is an object of the present invention to connect elements in a vehicle frame without having to provide holes in the elements to be connected. Such holes must meet strict tolerances, and require an extra manufacturing step of machining or stamping of the holes into the elements.

It is a further object of the present invention to provide a method of joining elements that does not result in the stack up of tolerances when multiple elements are joined.

It is another object of the present invention to provide a method of joining elements that are of materials which would have corrosive effects if joined in contact with one another through bolting, riveting or the like.

It is an additional object of the present invention to provide a method of joining elements which do not necessarily have similarly contoured surface portions as would be required to connect the elements by bolting, riveting, welding or the like.

It is a further object of the present invention to provide a method for joining elements that does not dictate the types of materials the elements must be made from. Rather, the method of the present invention accommodates elements of varying materials, thereby allowing materials to be used in a cost-effective manner.

Further objects and advantages of the present invention will be understood by those of skill in the art from the detailed description below in conjunction with the drawings.

BRIEF DESCRIPTION OF THE DRAWINGS

In the drawings, in which like numerals are used throughout to identify corresponding features through several views:

FIG. 6 is a perspective assembly view of two alternate elements being joined in accordance with the method of the present invention;

FIG. 7 is a schematic representation of a plurality of elements joined in a matrix, using the method of the present invention.

The drawings constitute a part of the specification and illustrate preferred embodiments of the invention. It will be understood that relative component sizes and material thicknesses are shown exaggerated to facilitate explanation.

DETAILED DESCRIPTION OF PREFERRED EMBODIMENTS

Figure 1:
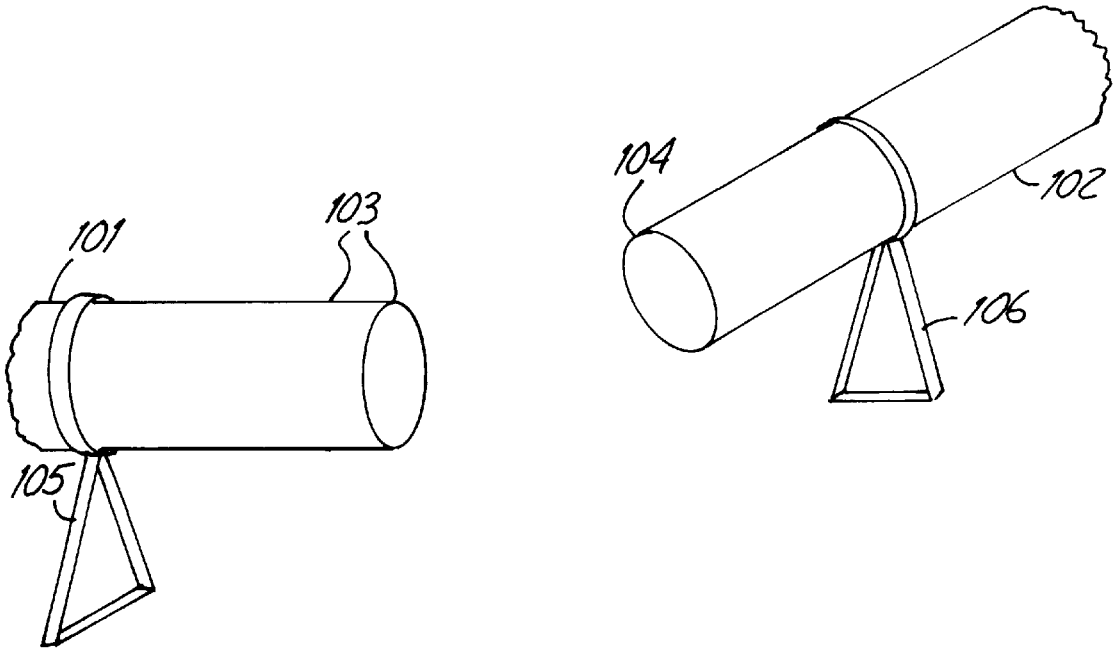
FIG. 1 is a perspective view of two elements, partially illustrated, positioned and fixtured to be joined together according to a step in the method of the present invention, with the elements and fixtures shown schematically.

FIG. 1 illustrates two elements or members 101 and 102 to be connected together. The elements are illustrated only schematically as cylinders. The actual elements to be connected using the method of the present invention could be of any desired configuration or shape.

Elements 101 and 102 are fixed in place by fixtures 105 and 106 which, again, are illustrated only schematically. Any sort of clamping or support stands which are capable of holding elements 101 and 102 in place during casting could be used.

Figure 2:
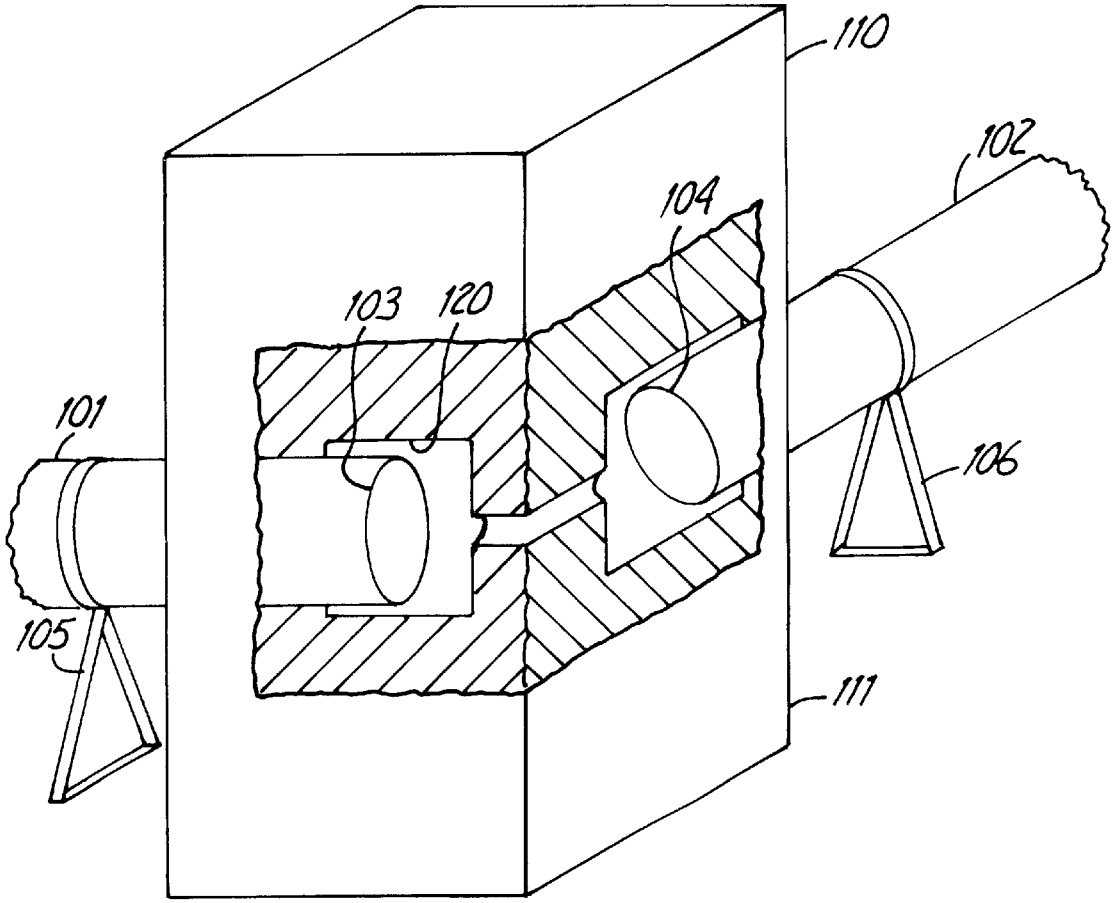
FIG. 2 is a schematic representation of a portion of the method of the present invention for joining two elements.

Once elements 101 and 102 are securely held in place, dies 110 and 111 are positioned to surround or envelop the mating portions 103 and 104 of elements 101 and 102. The dies 110 and 111, when in mating position, define a cavity 120 therein. Additionally, the dies 105 and 106 may be used to hold the elements 101 and 102 in place. In the illustration of FIG. 2, the mating portions of 103 and 104 of elements 101 and 102 are their ends. It should be understood by those skilled in the art that other portions or segments of two elements to be connected could be connected with the method of the present invention.

The cavity 120 is shaped to encompass or surround the mating portions 103 and 104 of the elements 101 and 102; axiomatically, the mating portions 103 and 104 of elements 101 and 102 extend into the die cavity 120. The dies 110 and 111 illustrated in FIG. 2 are only schematically illustrated, with a portion cut away and shown in cross-section. The configuration of the dies will be determined by the desired shape of the resulting node, and the manufacturing or molding criteria to accomplish such a shape.

After the dies 110 and 111 are closed around the elements 101 and 102, moldable material is introduced either by gravity or under pressure into the die cavity 120. The material fills the cavity 120 and forms a single continuous molded element which envelops mating portions 103 and 104 of elements 101 and 102 and holds them in the fixed position with respect to one another.

Figure 3:
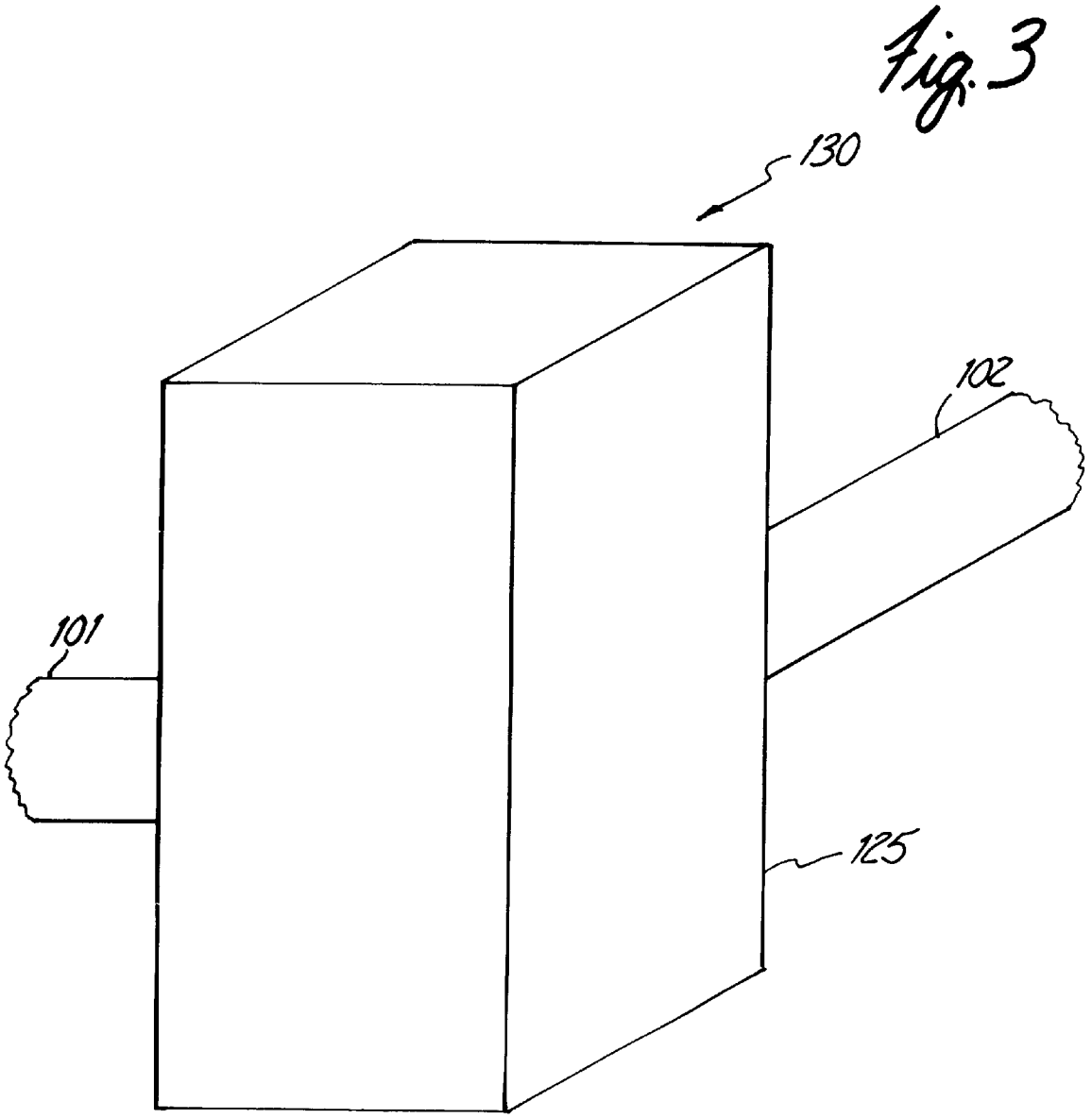
FIG. 3 is a perspective view of a schematic representation of a joint formed by the method of the present invention.

FIG. 3 schematically illustrates a completed node or joint 130. The molded portion 125 could be of any desired shape, contour, or configuration that can be achieved by molding. Features, such as additional brackets or other mounting structures, can be molded into the molded portion 125.

The material to be used in molding the node or joint 130 is any suitably moldable material, such as aluminum, zinc, magnesium, iron or steel or non-metallic material.

The elements to be joined by this method can be a variety of members and brackets that form a vehicle frame. For example, cross members can be connected to side rail members using the method of the present invention. Further, subassemblies such as engine cradles and rear suspension systems typically have multiple members and brackets which can be connected or joined by this method. The subassemblies can be connected to the cross members or side rail members using this method.

The elements can be of any material and made by any method that meets the strength and design requirements of the completed assembly. Examples of materials typically used for elements in a vehicle frame typically include steel, aluminum, composites and ceramics. The elements typically are formed by a variety of methods including stamping, extruding, rolling, hydroforming and casting.

Figure 4:
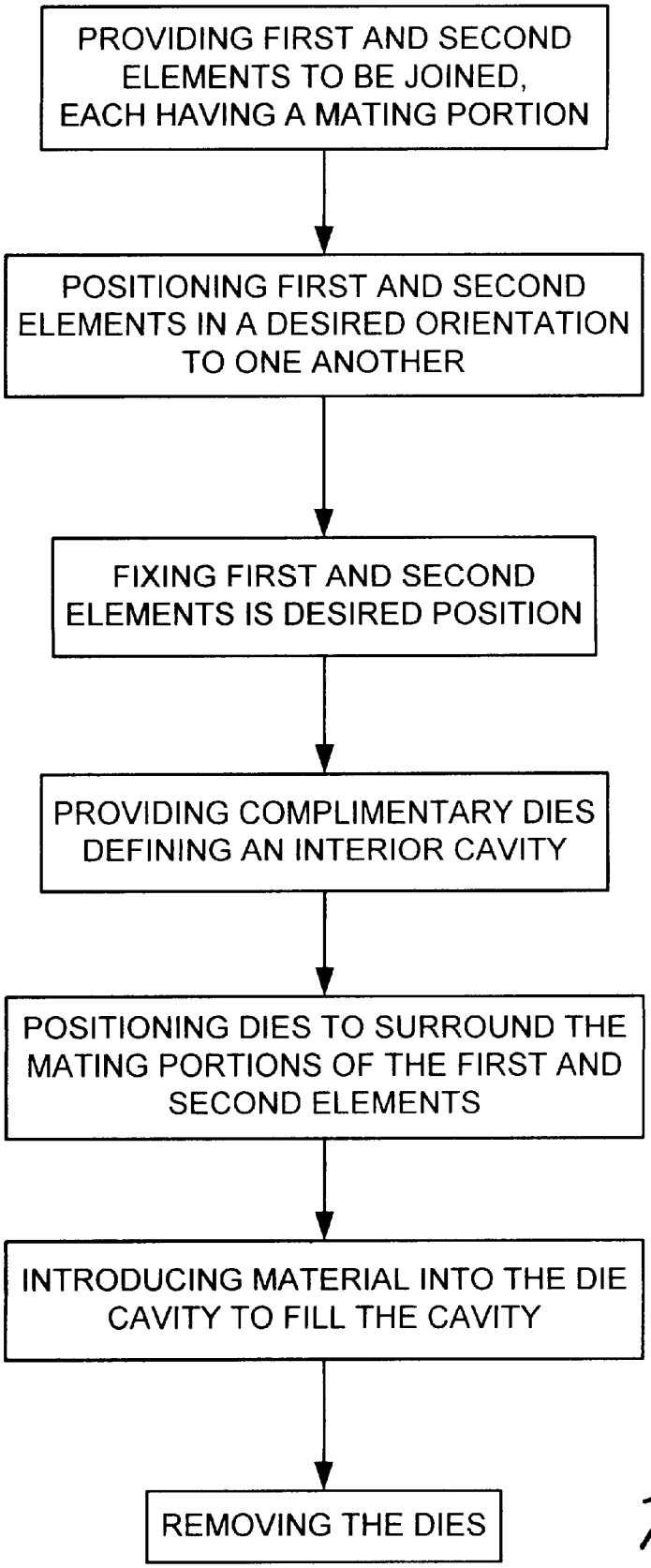
FIG. 4 is a flow chart presenting the steps of the method of the present invention.

FIG. 4 is a flowchart which sets forth the steps of the preferred method of the present invention. In short, the method begins with the step 130 of providing first and second elements to be joined, each having a mating portion. The elements are positioned 132 and fixed 134 in a desired orientation to one another. Complimentary or mating dies are provided 136 which, when coupled together define an interior cavity therein. The cavity is shaped to receive and surround mating portions of the elements. The dies are positioned 138 to surround the mating portions of the first and second elements. Next, material is introduced 140 by gravity or under pressure into the die cavity. Sufficient material is introduced to fill the cavity. Finally, the dies are removed 142, leaving a molded joint having the shape of the cavity. The molded joint connects the two elements together in the desired configuration.

Figure 5:
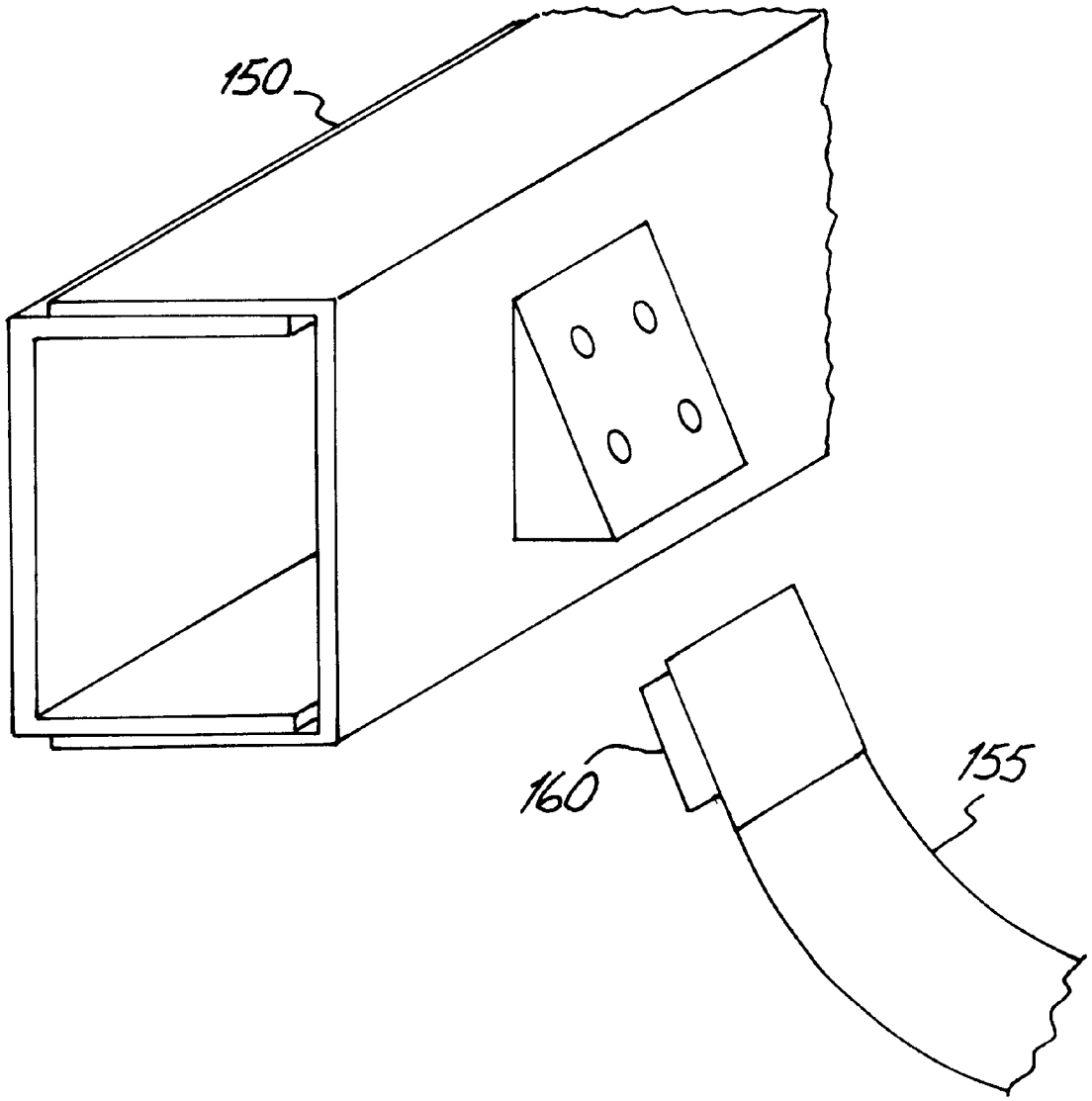
FIG. 5 is a perspective assembly view of two elements being joined in accordance with the method of the present invention.

FIG. 5 illustrates how the method of the present invention can be used to facilitate the connection between two elements of incompatible materials, such as steel and cast aluminum, which cause galvanic corrosion when brought into contact with one another in the presence of an electrolyte. A steel part or element 150 and a cast aluminum part 155 to be attached to the steel member 150 are selected and placed in relatively close proximity to each other. Using the method described above, a steel contact surface or plate 160 can be molded into the aluminum member 155. By molding the steel plate 160 into aluminum member 155, the connection between them is fluid tight, thereby excluding an electrolyte and preventing galvanic corrosion. The steel plate 160 can then be attached to steel element 150 by bolting, riveting, spot welded, or electric arc welded. An example of members that might benefit from this method of adding a steel contact surface, are steel side rail members and aluminum cross members.

FIG. 6 shows an alternative configuration in which a bracket or part is fabricated using the method of the present invention. In this case, an aluminum mounting bracket 158 is attached to a steel contact bracket 159. The steel contact bracket 159 can then easily be welded or attached to a frame member such as steel member 150.

FIG. 7 illustrates a lattice or matrix arrangement 170 of elements 180, 181, 182, and 183 connected together by a continuous molded portion 190 which surrounds each component and extends between the components or members 180, 181, 182, 183. This matrix arrangement 170 is formed by arranging and fixing elements, such as brackets in a desired spaced apart relationship. Dies are provided which define an interior cavity that surrounds or envelops at least a portion of each bracket and which defines channels between adjacent brackets. Molten material is injected into the cavity under pressure. The dies are removed, leaving the brackets molded together in a matrix or lattice arrangement. This matrix would then be connected to a vehicle frame.

Figure 8:
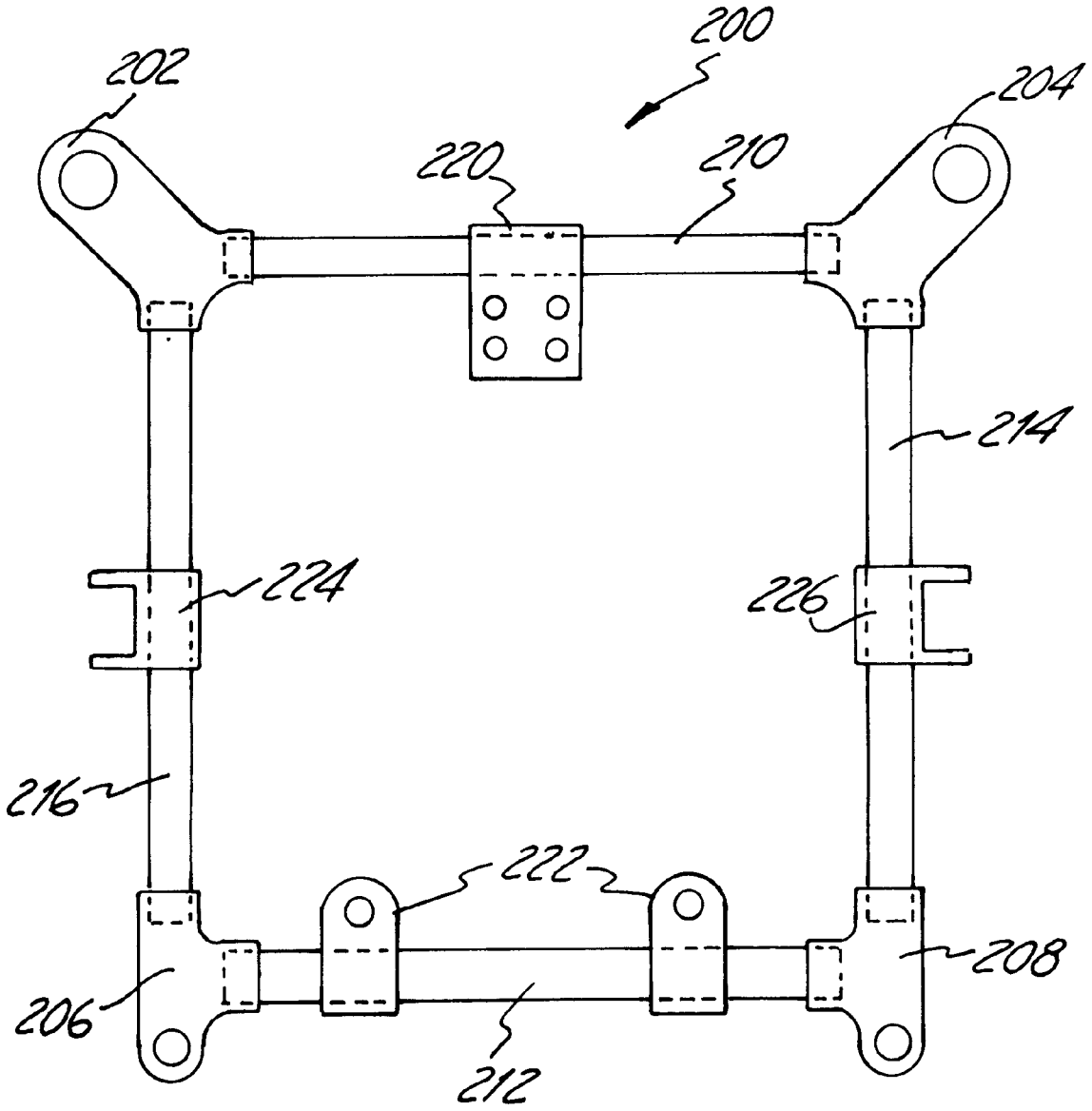
FIG. 8 is a top view of a matrix, or sample engine cradle, being joined using the method of the present invention.

Referring now to FIG. 8, there is shown a more specific embodiment of a device which utilizes the method of the present invention. This includes a specific lattice or matrix which makes up a typical engine cradle assembly 200. This particular engine cradle assembly 200 includes two front node mounting joints 202 and 204, two rear node joints 206 and 208 which connect a plurality of steel side members 210, 212, 214 and 216. Attached to a first steel side member 210 is an engine mount bracket 220. Attached to a second steel side member 212 is a pair of steering rack attachments 222. Lastly, attached to the third steel side member 214 and the fourth steel side member 216 are suspension attachment brackets 224 and 226. All of these parts cooperate one another to form a typical engine cradle which is capable of supporting all necessary elements in a vehicle.

It is to be understood that even though numerous characteristics and advantages of the preferred embodiments of the present invention have been set forth in the foregoing description, together with details of the structure and function of the invention, the disclosure is illustrative only and the present invention may be embodied in a variety of forms within the principles of this invention to the full extent indicated by the broad general meaning of the terms in which the appended claims are expressed. The above description, therefore, is not to be interpreted as limiting, but rather as a basis for the claims and as a basis for teaching persons skilled in the art the invention, which is defined by the appended claims.

It is claimed:

1. A method of joining elements in a vehicle frame, comprising the steps of:

a) providing two elements to be joined, each said element having a mating portion;

b) positioning said elements in a desired orientation;

c) providing complimentary dies defining an interior cavity;

d) positioning dies about the mating portions of said elements, such that the portions extend into said die cavity;

e) introducing moldable material under pressure into said die cavity to fill said cavity; and f) removing said die, leaving a molded joint connecting said elements in said desired orientation, said joint having the shape of said die cavity.

2. A method according to claim 1, wherein said material is molten.

3. A method according to claim 1, wherein said material is aluminum.

4. A method according to claim 1, wherein said material is zinc.

5. A method according to claim 1, wherein said material is magnesium.

6. A method according to claim 1, wherein said material is reinforced plastic.

7. A method according to claim 1, wherein one of said elements to be joined is a vehicle frame cross member.

8. A method according to claim 1, wherein one of said elements to be joined is a bracket member for attaching and supporting other components on a vehicle frame.

9. A method according to claim 1, wherein the elements to be joined are a vehicle frame cross member and a bracket member for attaching and supporting other components on a vehicle frame.

10. A method according to claim 1, wherein one of the elements to be joined is a vehicle frame side rail member.

11. A method according to claim 1, wherein the elements to be joined are a vehicle frame side rail member and a cross member.

12. A method according to claim 1, wherein the elements to be joined are a vehicle frame side rail member and a bracket.

13. A method according to claim 1, wherein one of the elements to be joined is a contact plate for subsequent attachment to a third element using conventional attachment methods.

14. A method according to claim 13, wherein said contact plate is steel.

15. A method according to claim 1, wherein said elements to be joined are a vehicle frame cross member and a contact plate.

16. A method according to claim 15, wherein said cross member is aluminum and said contact plate is steel.

17. A method according to claim 1, wherein said step of providing complimentary dies defining an interior cavity further comprises providing complimentary dies defining an interior cavity constructed and arranged to form mounting members on a molded joint resulting form introducing a moldable material into said die cavity, allowing said material to harden, thereby forming a joint, and removing said dies.

18. A method according to claim 1 wherein said elements to be joined are a bracket and a contact plate.

* * * * *

UNITED STATES PATENT AND TRADEMARK OFFICE

CERTIFICATE OF CORRECTION

PATENT NO. : 6,216,763 B1
DATED : April 17, 2001
INVENTOR(S) : Phillip C. Ruehl; Stephen L. Kretschmer It is certified that error appears in the above-identified patent and that said Letters Patent is hereby corrected as shown below:

Column 8,
Line 3, after the word "resulting, delete "form" and insert -- from --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*